US006334693B1

(12) United States Patent
Lee

(10) Patent No.: US 6,334,693 B1
(45) Date of Patent: Jan. 1, 2002

(54) WRENCH HAVING A LIGHT DEVICE

(76) Inventor: Yung Jen Lee, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/667,445

(22) Filed: Sep. 20, 2000

(51) Int. Cl.[7] ..... B25B 13/16; B25B 23/18
(52) U.S. Cl. ..... 362/119; 362/253; 81/166
(58) Field of Search ..... 362/190, 191, 362/119, 120, 253, 109; 81/165, 157, DIG. 3, 167, 166, 175

(56) References Cited

U.S. PATENT DOCUMENTS 4,967,613 A * 11/1990 Cone ..... 81/166
5,415,064 A * 5/1995 Chang ..... 81/166
5,899,554 A * 5/1999 Hsu ..... 362/119
6,029,548 A * 2/2000 Hsieh ..... 81/166
6,106,133 A * 8/2000 Lee ..... 362/119
6,116,746 A * 9/2000 Hsu ..... 362/119
6,186,638 B1 * 2/2001 Chang ..... 362/119

* cited by examiner

*Primary Examiner*—Thomas M. Sember

(57) ABSTRACT

A wrench includes a handle having a chamber for receiving a light device, and a cover pivotally secured to the handle for securing the light device in the handle. The light device may be easily and quickly replaced with the other one and has an exposed switch to be actuated by the users. The handle includes a fixed jaw, and a sliding jaw slidably received in the handle and forced to move toward and away from the fixed jaw. A bolt is secured to the sliding jaw and threaded through a knob which may move the bolt and the sliding jaw toward and away from the fixed jaw.

1 Claim, 3 Drawing Sheets

WRENCH HAVING A LIGHT DEVICE

BACKGROUND OF THE INVENTION

1. Field of the Invention

The present invention relates to a wrench, and more particularly to an adjustable wrench having a light device.

2. Description of the Prior Art

Typical wrenches comprise one or more batteries received in a handle, and a socket rotatably secured to the handle for receiving a light bulb or the like. U.S. Pat. No. 5,899,554 to Hsu discloses one of the typical wrenches. However, the light device includes a complicated configuration that may not be easily assembled and may not be easily repaired or fixed when the light device is out of order.

The present invention has arisen to mitigate and/or obviate the afore-described disadvantages of the conventional adjustable wrenches.

SUMMARY OF THE INVENTION

The primary objective of the present invention is to provide a wrench having an easily attached light device.

In accordance with one aspect of the invention, there is provided a wrench comprising a handle including a chamber formed therein, a light device received in the chamber of the handle, and a cover pivotally secured to the handle for securing the light device in the handle.

The handle includes a latch opening formed therein, the cover includes a first end pivotally secured to the handle and includes a second end having a latch for engaging with the latch opening of the handle and for engaging with and for securing the light device in the handle.

The handle includes a wall having at least one opening formed therein, the light device includes a switch received in the at least one opening of the wall for being actuated by a user.

The handle includes a first end having an arm and a fixed jaw extended therefrom, a sliding jaw slidably received in the first end of the handle, and means for moving the sliding jaw toward and away from the fixed jaw.

The moving means includes a bolt rotatably received in the first end of the handle and secured to the sliding jaw, and a knob rotatably received in the first end of the handle and threaded on the bolt for moving the sliding jaw toward and away from the fixed jaw when the knob is rotated relative to the bolt.

The first end of the handle includes a curved recess formed therein for receiving the bolt, and includes an aperture formed therein for rotatably receiving the knob.

A cap is further provided and secured to the first end of the handle, and includes an orifice formed therein for rotatably receiving the knob and for retaining the knob in the aperture of the handle. The first end of the handle includes a depression formed therein for receiving the cap.

The sliding jaw includes a bar secured to the bolt and includes a beam slidably secured to the first end of the handle. The first end of the handle includes a rail formed therein, the beam of the sliding jaw includes a slot formed therein for slidably receiving the rail and for slidably securing the sliding jaw to the handle.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
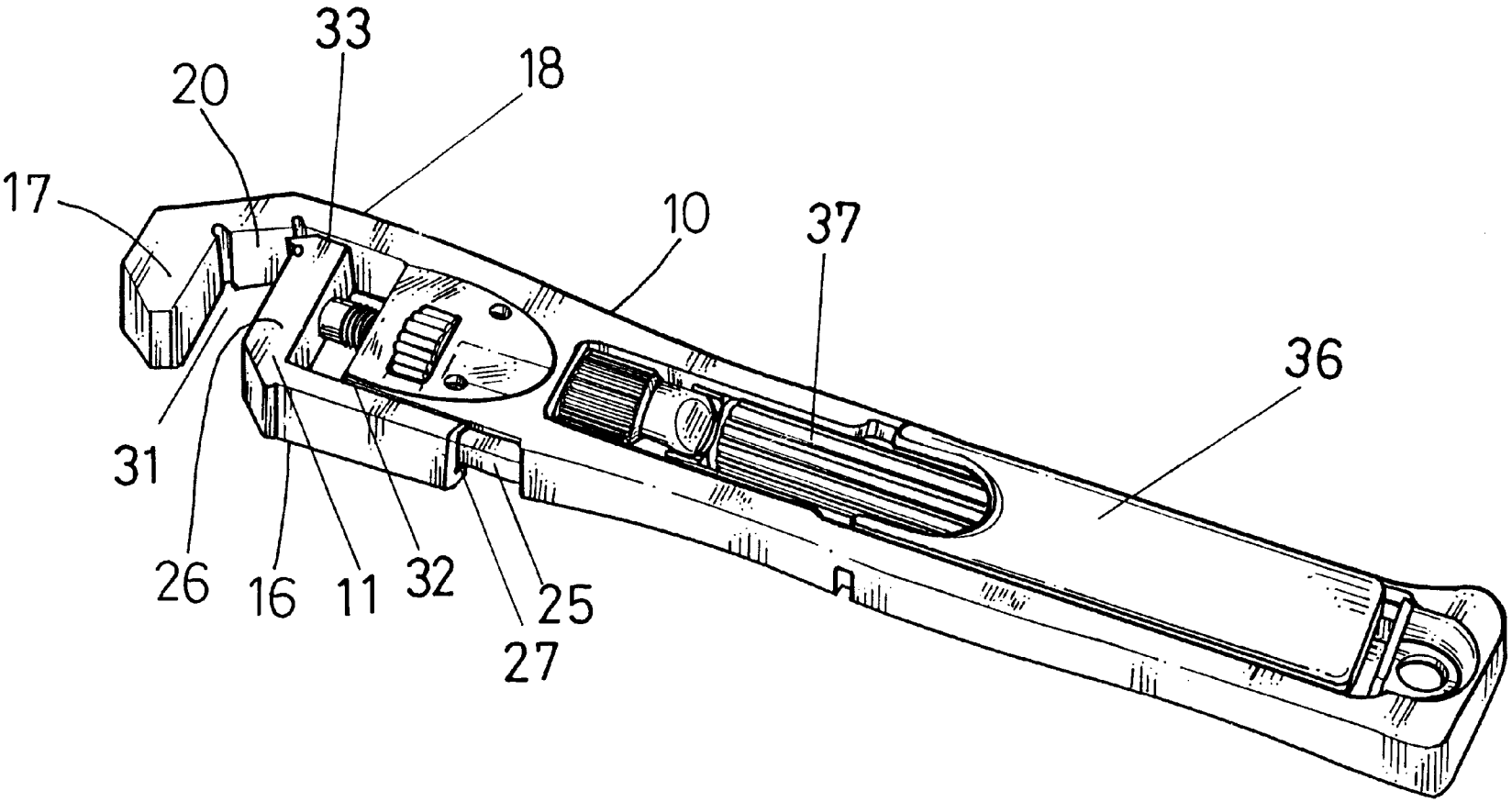
FIG. 1 is an upper perspective view of a wrench in accordance with the present invention.

Referring to the drawings, a wrench in accordance with the present invention is particularly an adjustable wrench and comprises a handle 10 including a fixed jaw 17 provided on one end thereof or extended from an arm 18 of the handle 10 and including an opening 31 formed in the one end thereof and defined by the fixed jaw 17. An inclined surface 20 is formed in the root portion or in one end of the fixed jaw 17. The one end of the handle 10 includes a curved recess 21 formed therein and communicating with the opening 31 thereof for rotatably and/or slidably receiving a bolt 12; and includes an aperture 22 formed therein and communicating with the curved recess 21 thereof for rotatably receiving a control ferrule or a knob 13 therein. The bolt 12 is threaded through the knob 13 and may be caused to move along the curved recess 21 of the handle 10 when the knob 13 is rotated relative to the handle 10. The handle 10 includes one or more screw holes 23, 24 formed therein and includes a depression 19 formed therein and communicating with the curved recess 21 and the aperture 22 and the screw holes 23, 24 of the handle 10.

The handle 10 further includes a longitudinal rail 25, such as a dovetail, formed in the one end thereof. A sliding jaw 11 includes a bar 26 secured to one end of the bolt 12 and includes a beam 16 having a slot 27 formed therein, such as a dovetail slot 27 formed therein, for slidably receiving the rail 25 and for slidably securing the sliding jaw 11 onto the handle 10 and for allowing the bar 26 of the sliding jaw 11 to be moved toward and away from the fixed jaw 17. The bar 26 of the sliding jaw 11 may be moved toward and away from the fixed jaw 17, by moving the bolt 12 with the rotation of the knob 13, in order to clamp and the drive the workpiece or the fastener between the fixed jaw 17 and the bar 26 of the sliding jaw 11. A cap 14 is received in the depression 19 of the handle 10 and includes one or more holes 29, 30 formed therein for receiving the fasteners 40 which may secure the cap 14 to the handle 10. The cap 14 includes an orifice 28 formed therein for rotatably receiving the knob 13 which is partially exposed or extended outward of the orifice 28 of the cap 14 such that the knob 13 may be rotated and actuated by the users. The orifice 28 of the cap 14 has a size arranged to rotatably retaining the knob 13 in the aperture 22 of the handle 10.

As best shown in FIG. 1, the bar 26 of the sliding jaw 11 includes one end 33 slidably engaging with the arm 18 of the handle 10; and the beam 16 of the sliding jaw 11 has an inner surface 32 slidably engaged with the handle 10 such that the sliding jaw 11 may be stably and solidly secured to the handle 10.

Figure 2:
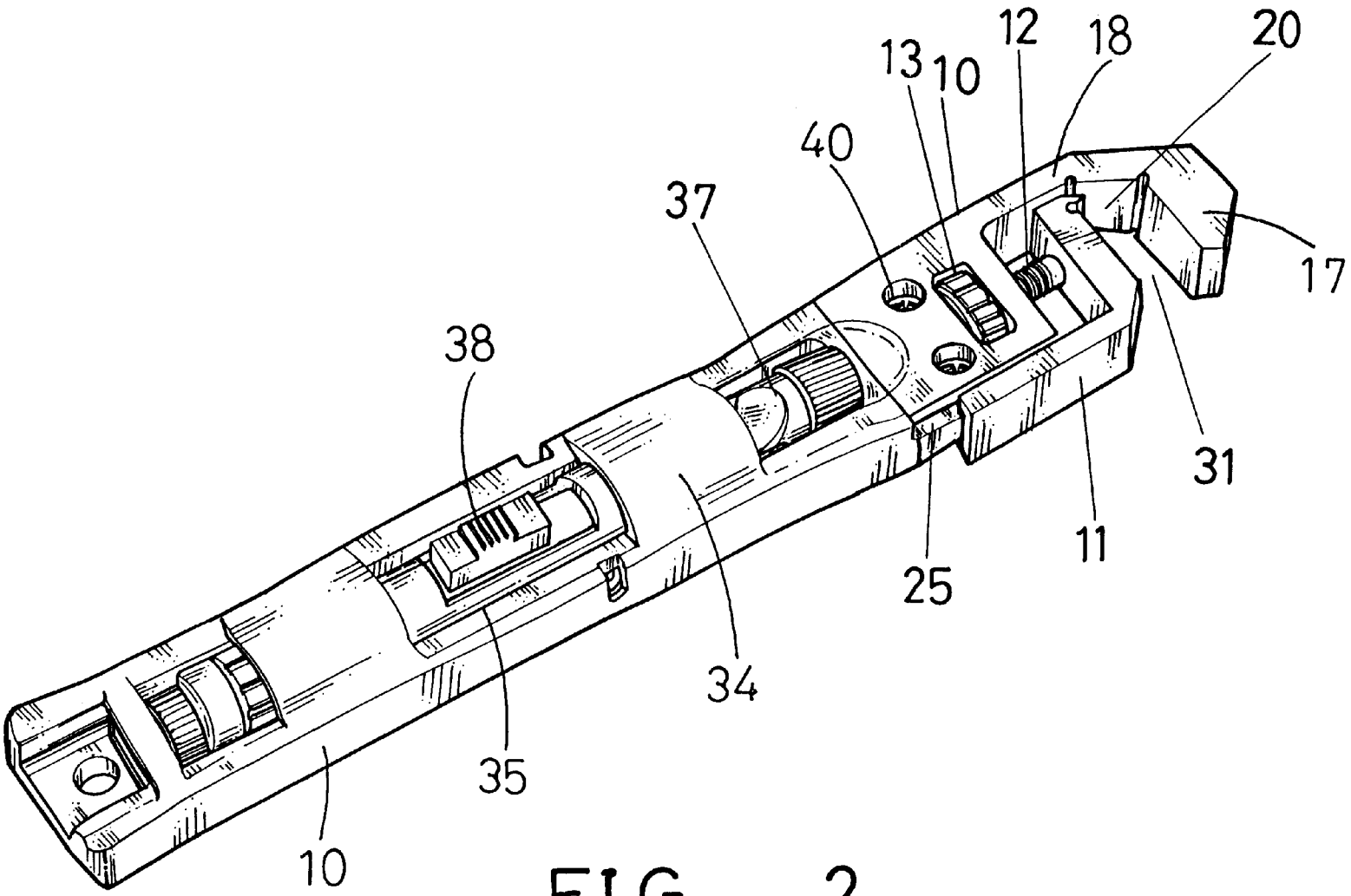
FIG. 2 is a bottom perspective view of the wrench.
Figure 3:
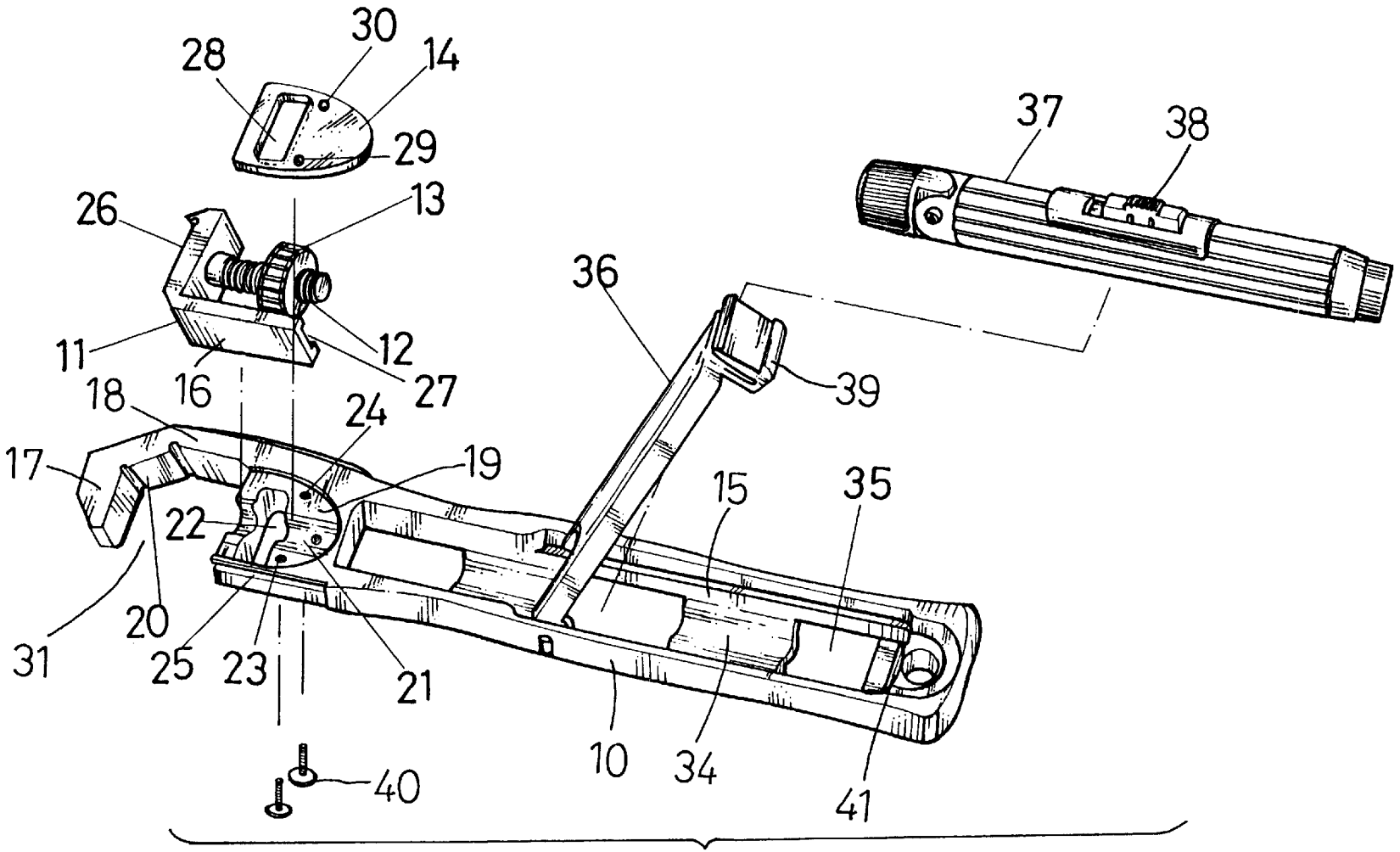
FIG. 3 is an exploded view of the wrench.

The handle 10 includes a chamber 15 formed therein and defined by a wall 34 for receiving a light device, such as a flashlight 37 therein, which may be easily and quickly engaged into the chamber 15 of the handle 10. The wall 34 includes one or more openings 35 formed therein for receiving the head of the light device 37 and/or the switch 38 of the light device 37 etc. A cover 36 has one end pivotally secured to the handle 10 and has a latch 39 provided on the other end thereof for engaging with a latch opening 41 of the handle 10 and for openably securing the cover 36 to the handle 10 and for securing the light device 37 in the handle 10. As shown in FIG. 2, the switch 38 of the light device 37 is exposed through the opening 35 of the wall 34 and may be easily operated by the user. In addition, the light device 37 may be easily and quickly changed or replaced with the other one when it is required to do so.

Accordingly, the wrench in accordance with the present invention includes an easily attachable light device that may be easily attached onto and disengaged from the handle of the wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a handle including a chamber formed therein, and including a wall having at least one opening formed therein, and including a first end having an arm and a fixed jaw extended therefrom and having an aperture formed therein, said first end of said handle including a rail formed in an outer side portion thereof, a sliding jaw slidably received in said first end of said handle, and including a bar slidably received in said first end of said handle and movable toward and away from said fixed jaw, and including a bolt extended from said bar and rotatably received in said first end of said handle, and including a beam extended from said bar and parallel to said bolt, said beam of said sliding jaw including a slot formed therein for slidably receiving said rail and for slidably securing said sliding jaw to said handle, a knob rotatably received in said aperture of said handle and threaded on said bolt for moving said sliding jaw toward and away from said fixed jaw when said knob is rotated relative to said bolt, a cap secured to said first end of said handle, and including an orifice formed therein for rotatably receiving said knob and for retaining said knob in said aperture of said handle, a light device received in said chamber of said handle, said light device including a switch received in said at least one opening of said wall for being actuated by a user, and a cover pivotally secured to said handle for securing said light device in said handle.

* * * * *